US008567891B2

(12) United States Patent
Nagoshi et al.

(10) Patent No.: US 8,567,891 B2
(45) Date of Patent: Oct. 29, 2013

(54) INKJET RECORDING HEAD AND INKJET RECORDING METHOD

(75) Inventors: Shigeyasu Nagoshi, Yokohama (JP); Satoshi Azuma, Kawasaki (JP); Yoshiaki Murayama, Tokyo (JP); Minoru Teshigawara, Saitama (JP); Susumu Hirosawa, Tokyo (JP); Yutaka Kano, Yokohama (JP); Takeshi Murase, Yokohama (JP); Kentarou Muro, Tokyo (JP); Masao Kato, Kawasaki (JP); Minako Kato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 12/960,428

(22) Filed: Dec. 3, 2010

(65) Prior Publication Data

US 2011/0310155 A1 Dec. 22, 2011

(30) Foreign Application Priority Data

Jun. 18, 2010 (JP) ..... 2010-139955

(51) Int. Cl.
*B41J 2/205* (2006.01)

(52) U.S. Cl.
USPC ..... 347/15

(58) Field of Classification Search
USPC ..... 347/15
See application file for complete search history.

(56) References Cited

U.S. PATENT DOCUMENTS 6,299,287 B1 * 10/2001 Williams et al. ..... 347/43
6,350,011 B1 * 2/2002 Karlinski ..... 347/40
6,808,249 B1 10/2004 Kneezel et al.

FOREIGN PATENT DOCUMENTS

JP 2005-178378 A 7/2005

* cited by examiner

*Primary Examiner* — Manish S Shah
*Assistant Examiner* — Jeffrey C Morgan
(74) *Attorney, Agent, or Firm* — Canon USA Inc. IP Division

(57) ABSTRACT

The present invention provides a recording apparatus including recording heads each including a plurality of nozzle arrays that are arranged so as to overlap, wherein the width with which the overlapping portions of the recording heads for colors that are simultaneously used with a relatively high frequency overlap in an intersecting direction that intersects an array direction of nozzles is smaller than the width with which the overlapping portions of the recording heads for colors that are simultaneously used with a relatively low frequency overlap in the intersecting direction.

20 Claims, 12 Drawing Sheets

INKJET RECORDING HEAD AND INKJET RECORDING METHOD

BACKGROUND OF THE INVENTION

1. Field of the Invention

The present invention relates to an inkjet recording apparatus and an inkjet recording method for recording an image on a recording medium by using an inkjet recording head.

2. Description of the Related Art

Japanese Patent Laid-Open No. 2005-178378 describes a full-line inkjet recording apparatus that includes a recording head and a conveying mechanism for conveying a recording medium. In the recording head, nozzle arrays (chips), each having a plurality of nozzles, are arranged in a staggered manner. The full-line inkjet recording apparatus performs recording over the entire width of a recording medium.

In general, overlapping portions exist in a full-line recording apparatus, because a plurality of chips are arranged in a staggered manner. The overlapping portions perform recording using two chips. Therefore, if the density balance between the two chips is not correct, the density of an image formed by these chips may become non-uniform, which reduces the quality of the image. Such a non-uniform density may be inconspicuous for a monochrome image. However, if the overlapping portions are disposed at the same position for different colors, an imbalance in the density is exaggerated and easily recognized as a non-uniform density.

In contrast, in the recording apparatus describe in Japanese Patent Laid-Open No. 2005-178378, the overlapping portions for different colors are separated from each other in the nozzle array direction, so that the effect of a non-uniform density described above is reduced.

However, in order to avoid overlapping of the recording heads for all colors, the length of the recording heads is increased in the nozzle array direction, which may increase the size of the recording apparatus.

SUMMARY OF THE INVENTION

According to a first aspect of the invention, an inkjet recording apparatus includes a recording unit configured to perform recording by moving recording heads each corresponding to one of a plurality of colors relative to a recording medium and by ejecting inks having the plurality of colors from the recording heads, the plurality of colors including a first color, a second color, a third color, and a fourth color, the recording heads each including a plurality of nozzle arrays that are arranged so as to be displaced from each other in an array direction of nozzles so that the nozzle arrays have an overlapping portion in an intersecting direction that intersects the array direction, wherein a proportion of colors recorded by using the first color ink and the second color ink to colors that are recordable by the inkjet recording apparatus is lower than a proportion of colors recorded by using the third color ink and the fourth color ink to colors that are recordable by the inkjet recording apparatus, and wherein a width with which the overlapping portion of the recording head for the first color and the overlapping portion of the recording head for the second color overlap in the intersecting direction is larger than a width with which the overlapping portion of the recording head for the third color and the overlapping portion of the recording head for the fourth color overlap in the intersecting direction.

According to a second aspect of the invention, an inkjet recording apparatus includes a recording unit configured to perform recording by moving recording heads each corresponding to one of a plurality of colors relative to a recording medium and ejecting inks having the plurality of colors from the recording heads, the plurality of colors including a first color, a second color, a third color, and a fourth color, the recording heads each including a plurality of nozzle arrays that are arranged so as to be displaced from each other in an array direction of nozzles so that the nozzle arrays have an overlapping portion in an intersecting direction that intersects the array direction, wherein a sum of an amount of first color ink and an amount of second color ink used for colors that are recordable by the inkjet recording apparatus is smaller than a sum of an amount of third color ink and an amount of fourth color ink used for colors that are recordable by the inkjet recording apparatus, and wherein a width with which the overlapping portion of the recording head for the first color and the overlapping portion of the recording head for the second color overlap in the intersecting direction is larger than a width with which the overlapping portion of the recording head for the third color and the overlapping portion of the recording head for the fourth color overlap in the intersecting direction.

According to a third aspect of the invention, an inkjet recording method includes performing recording by moving recording heads each corresponding to one of a plurality of colors relative to a recording medium and ejecting inks having the plurality of colors from the recording heads, the plurality of colors including a first color, a second color, a third color, and a fourth color, the recording heads each including a plurality of nozzle arrays that are arranged so as to be displaced from each other in an array direction of nozzles so that the nozzle arrays have an overlapping portion in an intersecting direction that intersects the array direction, wherein a proportion of colors recorded by using the first color ink and the second color ink to colors that are recordable is lower than a proportion of colors recorded by using the third color ink and the fourth color ink to colors that are recordable, and wherein a width with which the overlapping portion of the recording head for the first color and the overlapping portion of the recording head for the second color overlap in the intersecting direction is larger than a width with which the overlapping portion of the recording head for the third color and the overlapping portion of the recording head for the fourth color overlap in the intersecting direction.

According to a fourth aspect of the invention, an inkjet recording method includes performing recording by moving recording heads each corresponding to one of a plurality of colors relative to a recording medium and ejecting inks having the plurality of colors from the recording heads, the plurality of colors including a first color, a second color, a third color, and a fourth color, the recording heads each including a plurality of nozzle arrays that are arranged so as to be displaced from each other in an array direction of nozzles so that the nozzle arrays have an overlapping portion in an intersecting direction that intersects the array direction, wherein a sum of an amount of first color ink and an amount of second color ink used for colors that are recordable is smaller than a sum of an amount of third color ink and an amount of fourth color ink used for colors that are recordable, and wherein a width with which the overlapping portion of the recording head for the first color and the overlapping portion of the recording head for the second color overlap in the intersecting direction is larger than a width with which the overlapping portion of the recording head for the third color and the overlapping portion of the recording head for the fourth color overlap in the intersecting direction.

According to the present invention, in a recording apparatus that includes recording heads each including a plurality of chips (nozzle arrays) that are arranged so as to overlap, an increase in the size of the recording apparatus is suppressed.

Further features of the present invention will become apparent from the following description of exemplary embodiments with reference to the attached drawings.

DESCRIPTION OF THE EMBODIMENTS

First Embodiment

Figure 1:
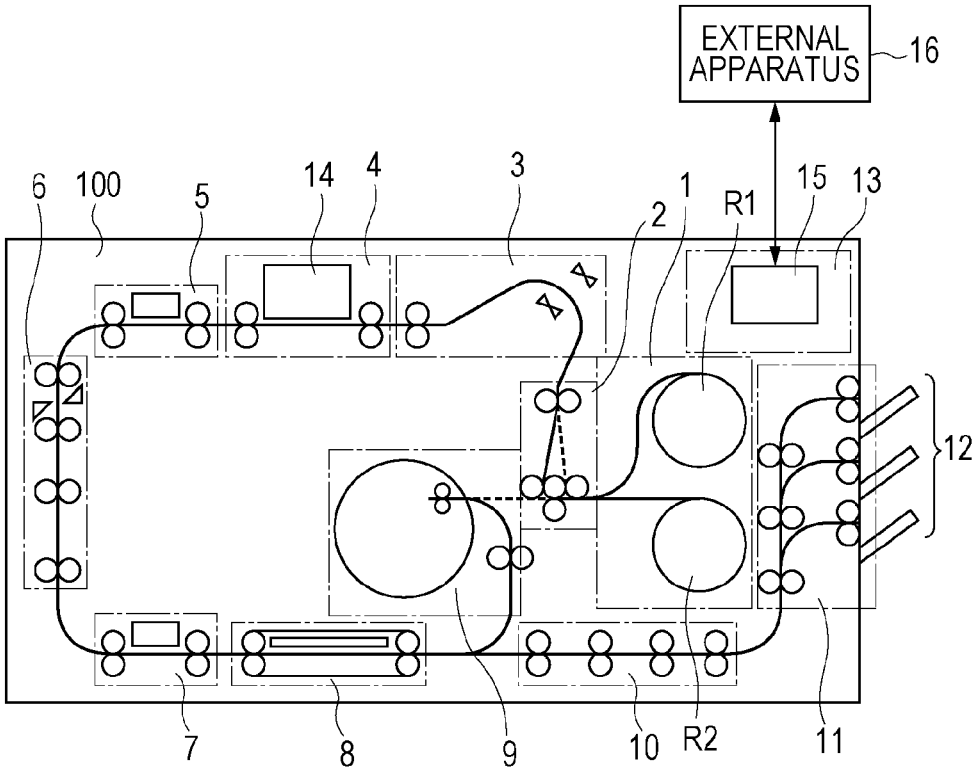
FIG. 1 is a schematic view of an inkjet recording apparatus to which the present invention is applicable.

The present invention is applicable to an inkjet recording apparatus that performs recoding by moving a recording head, which ejects ink, relative to a recording medium. Hereinafter, the structure of a printer will be described in detail. FIG. 1 is a schematic view of an inkjet recording apparatus 100 (hereinafter, simply referred to as a recording apparatus or a printer 100) to which the present invention is applicable. The printer 100 includes a sheet feeding unit 1, a decurling unit 2, an oblique sheet correction unit 3, a printing unit 4, an inspection unit 5, a cutter unit 6, an information recording unit 7, a dryer unit 8, a sheet winding unit 9, an output/conveyance unit 10, a sorter unit 11, an output tray 12, and a control unit 13. A recording medium (sheet) is conveyed along a sheet conveying path by a conveying mechanism illustrated with a solid line in FIG. 1, and the above units perform various processing on the sheet.

The sheet feeding unit 1 contains and feeds a rolled continuous sheet. The sheet feeding unit 1 contains two rolls R1 and R2, and feeds a sheet from one of the rolls R1 and R2 that is selected. Alternatively, the sheet feeding unit 1 may contain only one roll or more than two rolls. The decurling unit 2 reduces curling (warping) of a sheet that has been fed from the sheet feeding unit 1. The decurling unit 2 includes two pinch rollers and one driving roller. The decurling unit 2 warps the sheet in a direction opposite to curling of the sheet and pinches the sheet between the rollers so as to reduce the curling. The oblique sheet correction unit 3 corrects oblique conveyance (inclination with respect to the proper conveyance direction) of the sheet that has passed through the decurling unit 2. In the oblique sheet correction unit 3, an edge of the sheet to be aligned is pressed against a guiding member, so that the oblique conveyance of the sheet is corrected.

The printing unit 4 forms an image on the sheet using a recording head 14 while the sheet is being conveyed. The printing unit 4 includes a plurality of conveying rollers that convey the sheet. The recording head 14 is a full-line recording head, in which nozzles are formed so as to extend over the entire width of the sheet. A plurality of recording heads are arranged in the conveying direction. In the present embodiment, the recording heads for seven colors, including cyan (C), magenta (M), yellow (Y), light cyan (Lc), light magenta (Lm), gray (Gy), and black (Bk) are arranged. Ink may be ejected from the nozzles by using exothermic elements, piezoelectric elements, electrostatic element, or MEMS elements. Color inks are respectively supplied from ink tanks to the recording heads through ink tubes.

The inspection unit 5 optically reads a test pattern or an image printed on the sheet by the printing unit 4, and thereby inspects the state of nozzles in the recording head, the state of sheet conveyance, and the position of the image. The cutter unit 6 includes a mechanical cutter that cuts the sheet, which has being printed, into cut sheets having a predetermined length. The cutter unit 6 includes a plurality of conveying rollers for feeding the sheet to the next step. The information recording unit 7 records print-related information, such as a serial number of printing or the date of printing, on the back side of the sheet that has been cut. The dryer unit 8 dries the ink in a short time by heating the sheet that has been printed by the printing unit 4. The dryer unit 8 includes a conveying belt and a conveying roller for feeding the sheet to the next step.

The sheet winding unit 9 temporarily winds a continuous sheet, whose front side has been printed, when duplex printing is performed. The sheet winding unit 9 includes a winding drum for winding the sheet. When the front side has been printed, the continuous sheet is temporarily wound around the winding drum before being cut. After the sheet has been wound, the winding drum rotates in a reverse direction, and the sheet is fed to the decurling unit 2 and to the printing unit 4. Because the sheet has been reversed, the printing unit 4 can print the back side of the sheet. The duplex printing operation will be described in detail below.

The output/conveyance unit 10 conveys the sheet, which has been cut by the cutter unit 6 and dried by the dryer unit 8, to the sorter unit 11. When necessary, the sorter unit 11 sorts the printed sheets into groups and outputs the groups of sheets to different trays of the output tray 12. The control unit 13 performs the overall control of the printer.

Figure 2:
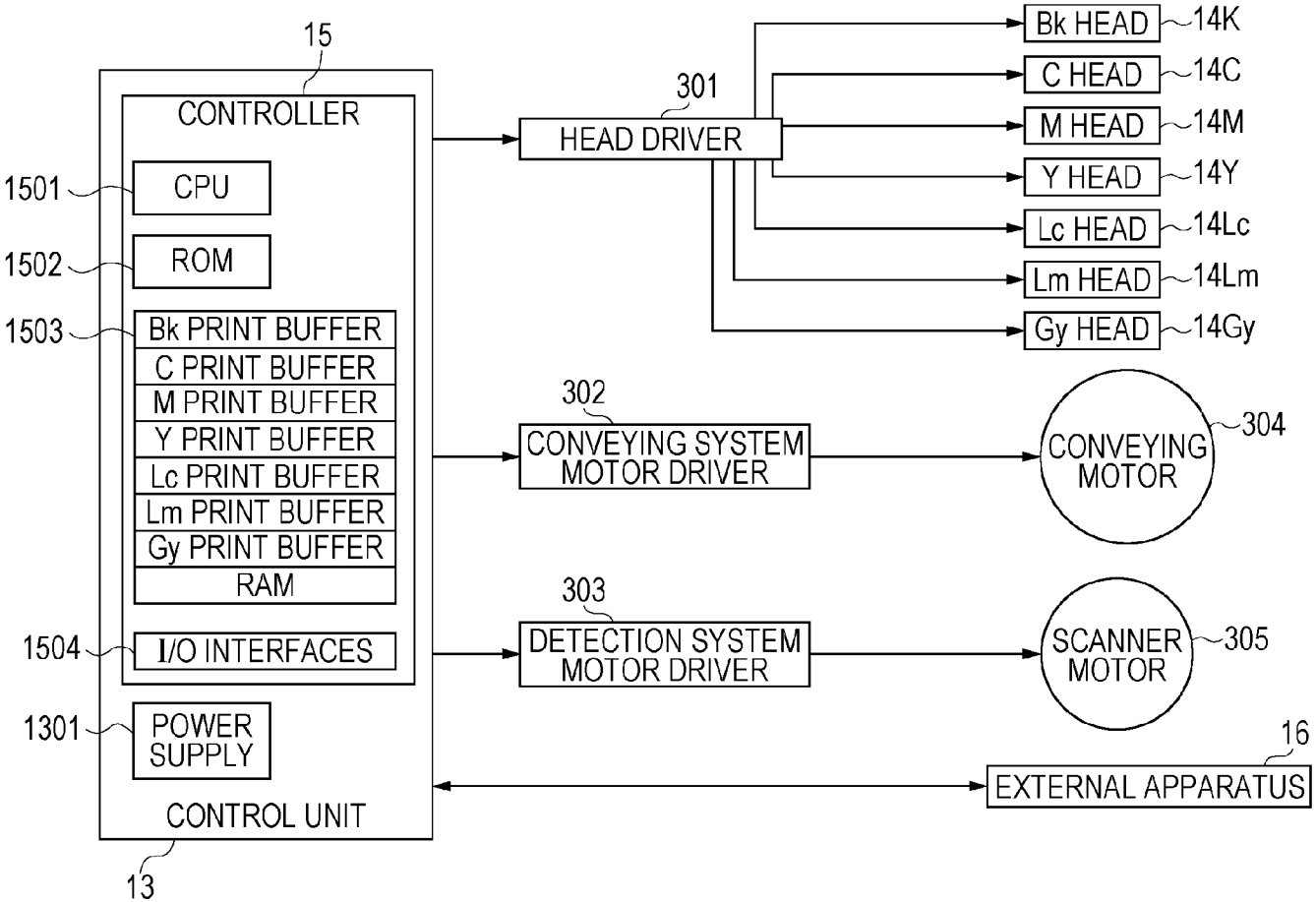
FIG. 2 is a schematic block diagram of a control unit of the inkjet recording apparatus of FIG. 1.

FIG. 2 is a control block diagram of the printer. The control unit 13 includes the controller 15 and a power supply 1301. The controller 15 includes a CPU 1501, a ROM 1502, a RAM 1503, and I/O interfaces 1504. An operation of the printer is controlled on the basis of a command that is sent from the controller 15 or an external apparatus 16, which is connected to the controller 15 through the I/O interfaces 1504, such as a host computer.

When the controller 15 receives a signal from the external apparatus 16, the controller 15 generates recording data to be recorded on the sheet S using the recording head. The recording data is stored in the RAM 1503 as a print buffer. Moreover, the controller 15 transfers the data in the print buffer to a head driver 301. The head driver 301 converts the data into data for ejecting ink droplets using recording heads for different colors, and thereby performs a recording operation. The details of the image processing will be described below.

The controller 15 controls motor drivers, including a conveying system motor driver 302 and a detection system motor driver 303, so as to drive driving sources, such as a conveying motor 304 and a scanner motor 305, and thereby performs a sheet-conveying operation and a detection operation.

Figure 3A:
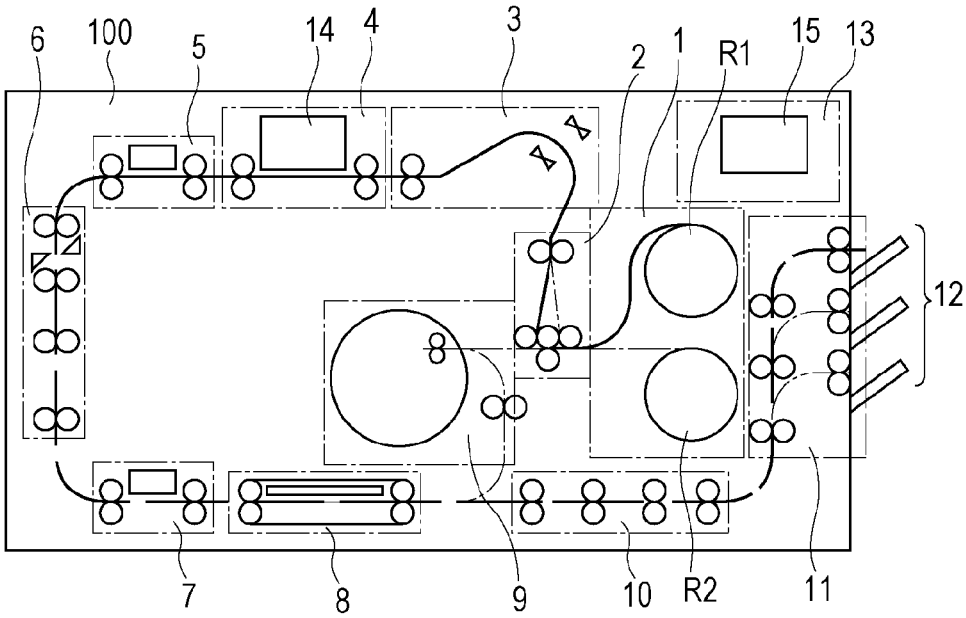
FIGS. 3A and 3B illustrate printing operations performed by the inkjet recording apparatus of FIG. 1.

Next, the basic operation of printing will be described. Both the simplex printing operation and the duplex printing operation will be described, because these are not the same. FIG. 3A illustrates the simplex printing operation. A thick line represents a conveying path along which a sheet is supplied from the sheet feeding unit 1, printed, and output to the output tray 12. The sheet is supplied from the sheet feeding unit 1, decurled by the decurling unit 2, and has the conveying direction corrected by the oblique sheet correction unit 3. Then, the printing unit 4 prints the first side of the sheet. The printed sheet passes through the inspection unit 5, and the cutter unit 6 cuts the sheet into cut sheets each having a predetermined length. When necessary, the information recording unit 7 records print-related information on a back side of the cut sheet. The cut sheets are individually conveyed to the dryer unit 8, which dries the cut sheets. Subsequently, the cut sheets pass through the output/conveyance unit 10 and are successively output to and stacked on the output tray 12 of the sorter unit 11.

Figure 3B:
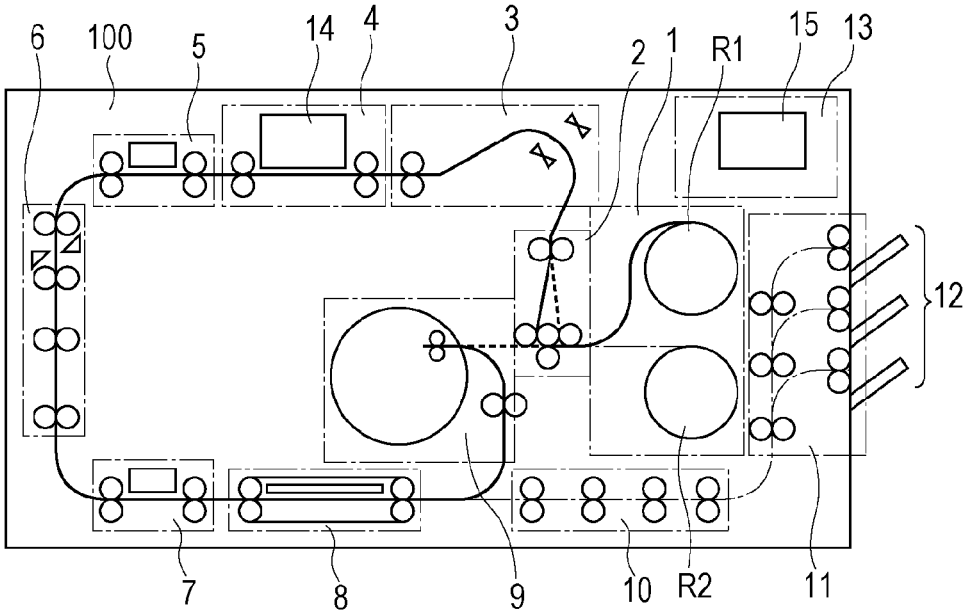

FIG. 3B illustrates the duplex printing operation. During the duplex printing operation, a front surface printing sequence and a back surface printing sequence are successively performed. In the front surface printing sequence, the units from the sheet feeding unit 1 to the inspection unit 5 perform operations the same as those for the simplex printing operation described above. The cutter unit 6 does not cut the continuous sheet, and the continuous sheet is conveyed the dryer unit 8. The dryer unit 8 dries ink on the front side of the sheet. Then, the sheet is conveyed to a path in the sheet winding unit 9 instead of a path in the output/conveyance unit 10. The sheet is wound around a winding drum of the sheet winding unit 9, which rotates in the normal direction (counterclockwise in the figures). When printing on the front side of the sheet is finished in the printing unit 4, the cutter unit 6 cuts the continuous sheet at a cut position, which is at the trailing end of the printed area. A part of the continuous sheet downstream of the cut position with respect to the conveying direction (a part including the printed area) passes through the dryer unit 8 and is wound by the sheet winding unit 9 until the trailing end of the sheet (the cut position) is wound. The remaining part of the continuous sheet upstream of the cut position with respect to the conveying direction is wound back by the sheet feeding unit 1 so that the leading end of the sheet (the cut position) does not remain in the decurling unit 2. Thus, the front surface printing sequence is finished.

When the front surface printing sequence is finished, the back surface printing sequence is started. In the back surface printing sequence, first, the winding drum of the sheet winding unit 9 rotates in a direction opposite to the winding direction (clockwise in the figures). The leading end of the sheet (i.e., the trailing end of the sheet when the sheet was wound) is fed into the decurling unit 2. The decurling unit 2 performs decurling in a direction opposite to that of the previous decurling operation. This is because the sheet has been wound around the winding drum of the sheet winding unit 9 in a reversed manner compared with the time when the sheet was wound around the sheet feeding unit 1, and the sheet is curled in the opposite direction. Then, the sheet passes through the oblique sheet correction unit 3, and the printing unit 4 prints the back side of the continuous sheet. The printed sheet passes through the inspection unit 5, and the cutter unit 6 cuts the continuous sheet into cut sheets each having a predetermined length. The information recording unit 7 does not record print information on the cut sheet because both sides of the cut sheet have been printed. The cut sheets are individually conveyed to the dryer unit 8, passes through the output/conveyance unit 10, and successively output to and stacked on the output tray 12 of the sorter unit 11. Thus, the back surface printing sequence is finished.

Figure 4A:
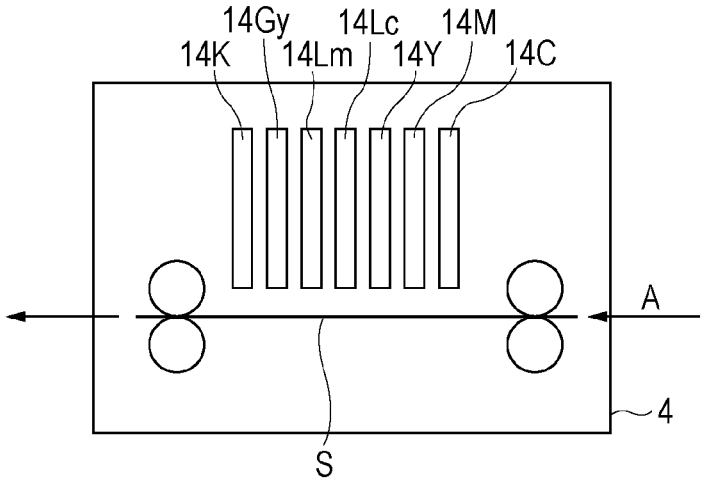
FIGS. 4A to 4E are schematic views of a printing unit of the inkjet recording apparatus of FIG. 1.

Next, the structure of the printing unit 4 of the present embodiment will be described. FIG. 4A is a schematic view of the printing unit 4 of the present embodiment. The printing unit 4 includes recording heads for seven colors: a recording head 14K, a recording head 14Lc, a recording head 14Lm, a recording head 14Gy, a recording head 14Y, a recording head 14M, and a recording head 14C. The recording head 14K ejects black ink, the recording head 14Lc ejects light cyan ink, and the recording head 14Lm ejects light magenta ink. The recording head 14Gy ejects gray ink, and the recording head 14Y ejects yellow ink. The recording head 14M ejects magenta ink, and the recording head 14C ejects cyan ink. A sheet S is conveyed in a conveying direction (direction of arrow A) that intersects (in the present embodiment, perpendicularly intersects) a direction in which nozzles are arranged (direction of arrow B). The recording head for seven colors successively perform recording on the sheet S.

Figure 4B:
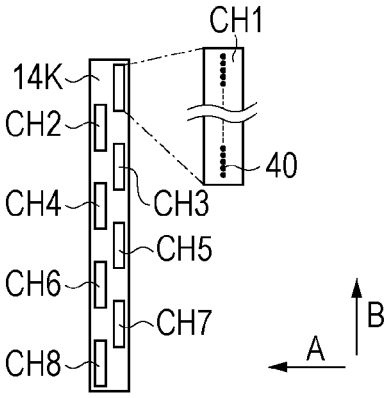

FIG. 4B illustrates the disposition of nozzles in the recording head 14K. The recording head 14K includes eight recording chips CH1 to CH8. Each chip includes a nozzle array having a plurality of nozzles 40 for ejecting ink. Each chip may include a plurality of nozzle arrays, and the plurality of nozzle arrays may be arranged so as to be separated from each other with a distance smaller than the nozzle pitch. Dispositions of the nozzles in the recording heads for other colors are the same as that of the recording head 14K.

Figure 4C:
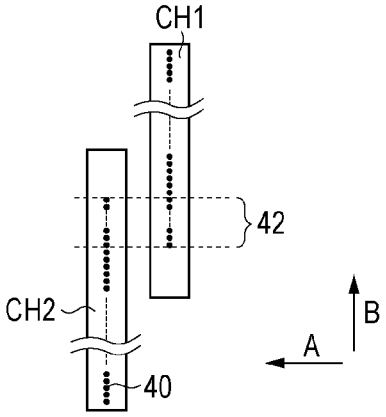
Figure 4D:
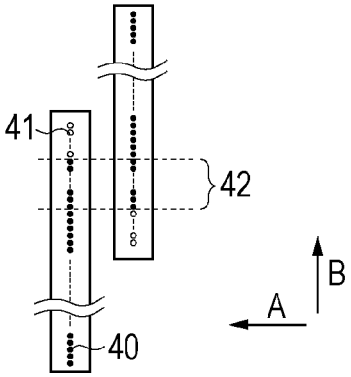
Figure 4E:
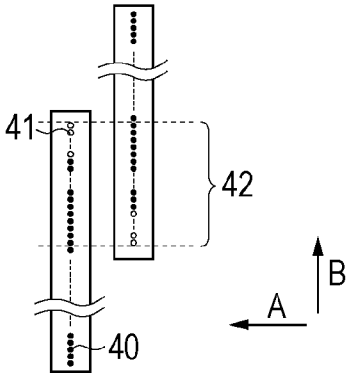

FIGS. 4C to 4E illustrate the overlapping portions of the chip CH1 and the chip CH2. The present invention is applicable to any of the structures of the recording heads illustrated in FIGS. 4C to 4E. In FIGS. 4C to 4E, the nozzles 40, which are represented by black circles, are nozzles used for recording. Nozzles 41, which are represented by white circles, are unused nozzles that are not used for recording. The unused nozzles 41 include two types of nozzles: nozzles that are capable of injecting ink and that are not used; and nozzles that are incapable of ejecting ink. The former type of nozzles are, for example, prepared for registration adjustment. The latter type of nozzles are, for example, disposed at an end of the nozzle array in order to prevent drying of nozzles.

FIG. 4C illustrates the case where the portion of the chips CH1 and CH2 that overlap in the conveying direction (direction of arrow A) is an overlapping portion 42, and all nozzles in the overlapping portion 42 are the used nozzles 40. FIG. 4D illustrates the case where a part of the portion of the chips CH1 and CH2 that overlap in the conveying direction (direction of arrow A) is the overlapping portion 42, and all nozzles in the overlapping portion 42 are the used nozzles 40. FIG. 4E illustrates the case where the portion of the chips CH1 and CH2 that overlap in the conveying direction (direction of arrow A) is the overlapping portion 42, and some of the nozzles, which are in end portions of the nozzle arrays, in the overlapping portion 42 are the unused nozzles 41 and the remaining nozzles in the overlapping portion 42 are the used nozzles 40. The present invention is applicable to any of the structures of the recording heads illustrated in FIGS. 4C to 4E. In the overlapping portions illustrated in FIGS. 4C to 4E, recording is performed by allocating recording data to two chips (nozzle arrays), so that a recording density in the overlapping portions becomes the same as that for nozzle areas other than the overlapping portions.

Characteristics of Present Embodiment

Figure 5:
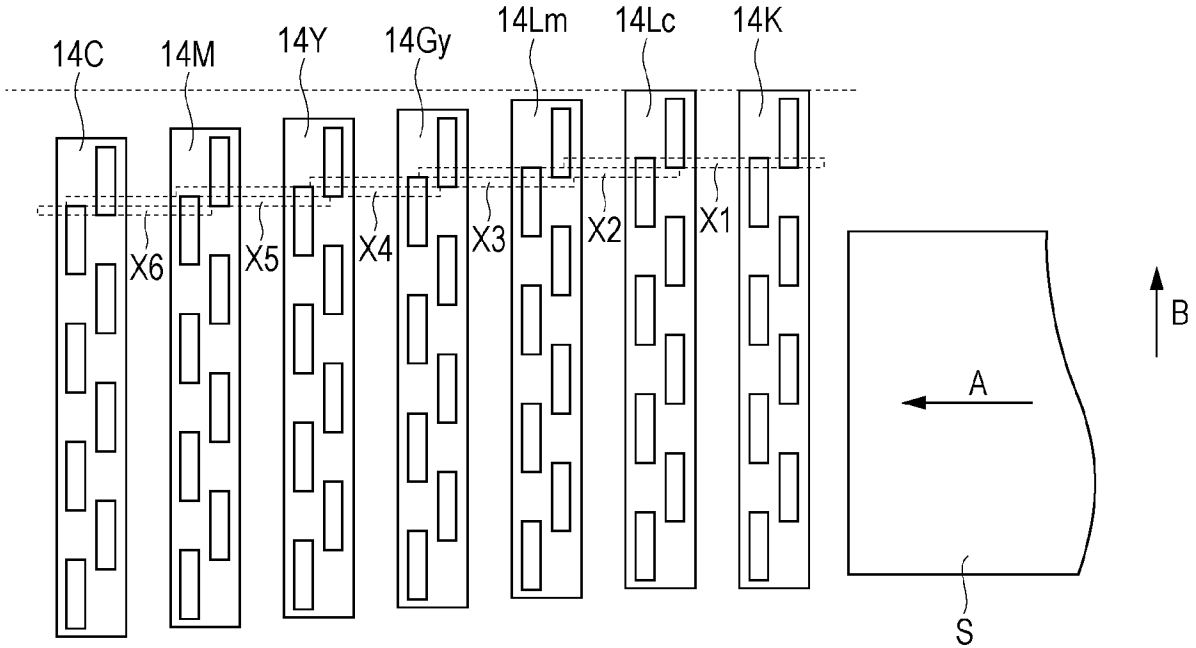
FIG. 5 illustrates the disposition of recording heads of the inkjet recording apparatus of FIG. 1.

FIG. 5 illustrates the disposition of recording heads according to the present embodiment. In the present embodiment, the recording head 14K for K, the recording head 14Lc for Lc, the recording head 14Lm for Lm, the recording head 14Gy for Gy, the recording head 14Y for Y, the recording head 14M for M, and the recording head 14C for C are disposed.

Regions X1 to X6, which are surrounded by dotted lines in FIG. 5, are the regions of the sheet S that are recorded by the overlapping portions of the recording heads. The region X1 is recorded by the overlapping portions of two recording heads, that is, the overlapping portion of the recording head 14K and the overlapping portion of the recording head 14Lc. The region X2 is recorded by the overlapping portion of one recording head, that is, the recording head 14Lm. Each of the regions X3 to X6 is recorded by the overlapping portion of one recording head. As illustrated in FIG. 5, the positions of the overlapping portions of the recording heads 14K and 14Lc are the same in the nozzle array direction (direction of arrow B). In contrast, the overlapping portions of the recording heads 14Lm, 14Gy, 14Y, 14M, and 14C are displaced from each other in the nozzle array direction (direction of arrow B).

Figure 6:
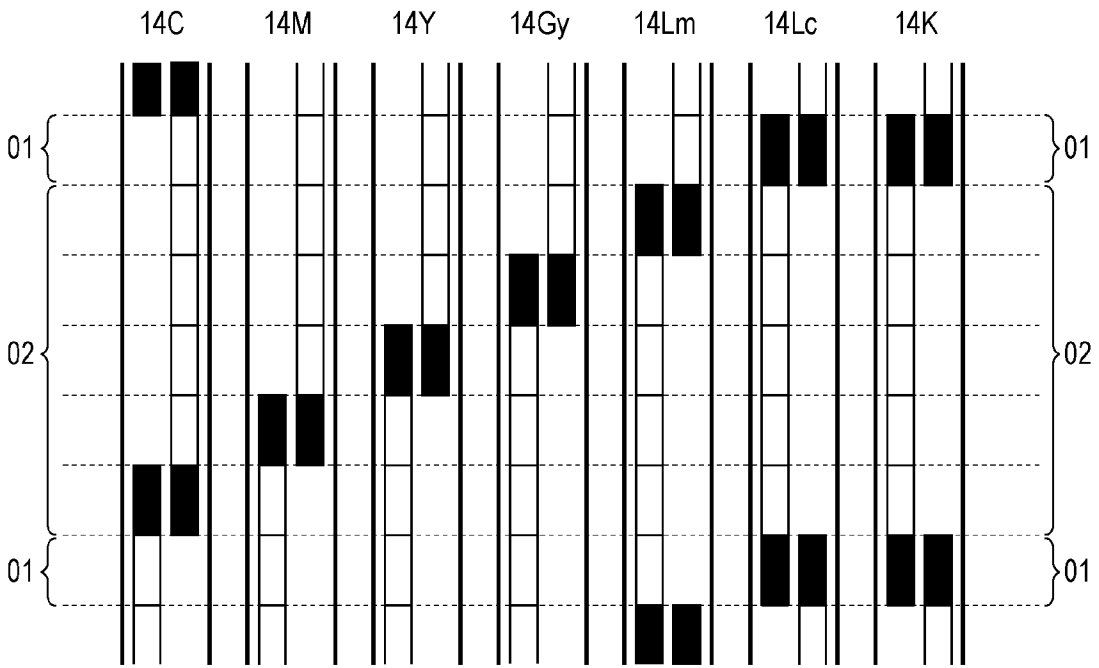
FIG. 6 illustrates the positional relationship between overlapping portions of recording heads according to a first embodiment.

FIG. 6 illustrates the positional relationship between overlapping portions for different colors in the printer according to the first embodiment. As illustrated in FIG. 6, in the present embodiment, the recording heads 14K, 14Lc, 14Lm, 14Gy, 14Y, 14M, and 14C for seven colors are arranged in the conveying direction. Solid black portions in FIG. 6 are the overlapping portions of the recording heads. The recording head for each color includes eight chips. Therefore, each recording head has seven overlapping portions. However, in FIG. 6, only one or two overlapping portions are illustrated for each recording head.

In FIG. 6, a region O1 is a region that is recorded by the overlapping portion of the recording head 14K and the overlapping portion of the recording head 14Lc. The region O1 corresponds to the region X1 in FIG. 5. A region O2 is a region that is recorded by the overlapping portions of the recording heads 14Lm, 14Gy, 14Y, 14M, and 14C. The region O2 corresponds to the sum of regions X2 to X6 in FIG. 5.

As can be seen from FIG. 6, in the present embodiment, the position of the recording head 14K and the position of the recording head 14Lc are the same in the nozzle array direction, and the overlapping portions of these heads record the same region O1. In this way, by disposing at least two recording heads so that the positions of the overlapping portions of these recording heads are the same in the nozzle array direction, the length of the recording head in the nozzle array direction may be reduced as compared with a case where the overlapping portions of all recording heads for the plurality of colors are disposed so as to be displaced from each other.

Next, the reason for making the positions of the overlapping portions of the recording head 14K and the recording head 14Lc the same in the nozzle array direction in this embodiment will be described.

Figure 7:
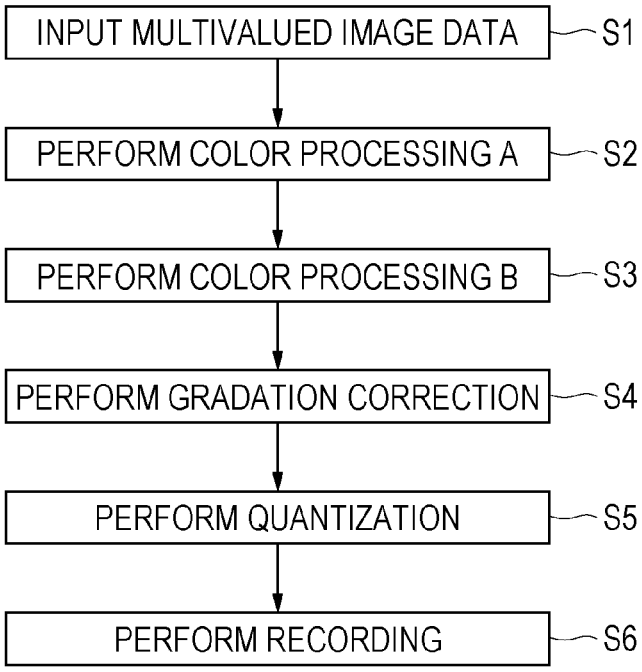
FIG. 7 is a flowchart of image processing performed by the inkjet recording apparatus of FIG. 1.

First, referring to FIG. 7, the flowchart of image processing will be described. In the following description, it is assumed that all steps of the image processing are performed by the printer 100. However, a part or all of the steps may be performed by an external apparatus (host apparatus).

In step S1, multivalued image data is input to the printer. The multivalued image data is 8-bit RGB data. Next, in step S2, color processing A is performed. This is gamut mapping, which compresses and expands the multivalued image data to colors that are reproducible by the printer. In the color processing A, the input RGB data is converted to multivalued data for R'G'B' that has been mapped.

In step S3, color processing B is performed. This is color separation processing, in which the converted data for R'G'B' is converted to data for ink colors used by the printer. Because the present embodiment uses seven color inks, conversion from R'G'B' to C, M, Y, Bk, Lc, Lm, and Gy is performed. In step S4, gradation correction is performed to correct the gradation characteristics of ink colors C, M, Y, Bk, Lc, Lm, and Gy. In the steps S2, S3, and S4, the conversion described above is performed using a lookup table.

In step S5, quantization is performed on the data whose gradation has been corrected for each ink color. To be specific, a generally used quantization method, such as error diffusion or dithering, is used. In step S6, the data that has been processed in steps S1 to S5 is supplied to the recording heads as signal values, sorted for recording, and allocated to the overlapping portions. Then, ink is ejected and recording is performed on a recording sheet.

In the color processing B of step S3, a lookup table, which contains one-to-one correspondence between the signal value for R'G'B' and the signal value for the ink colors C, M, Y, Bk, Lc, Lm, and Gy, is used. An example of the correspondence between signal values for R'G'B' and signal values for the ink colors is as follows.

Input values: R'=10, G'=10, B'=10

Output values: C=5, M=5, Y=5, Bk=220, Lc=0, Lm=0, Gy=20

Figure 8:
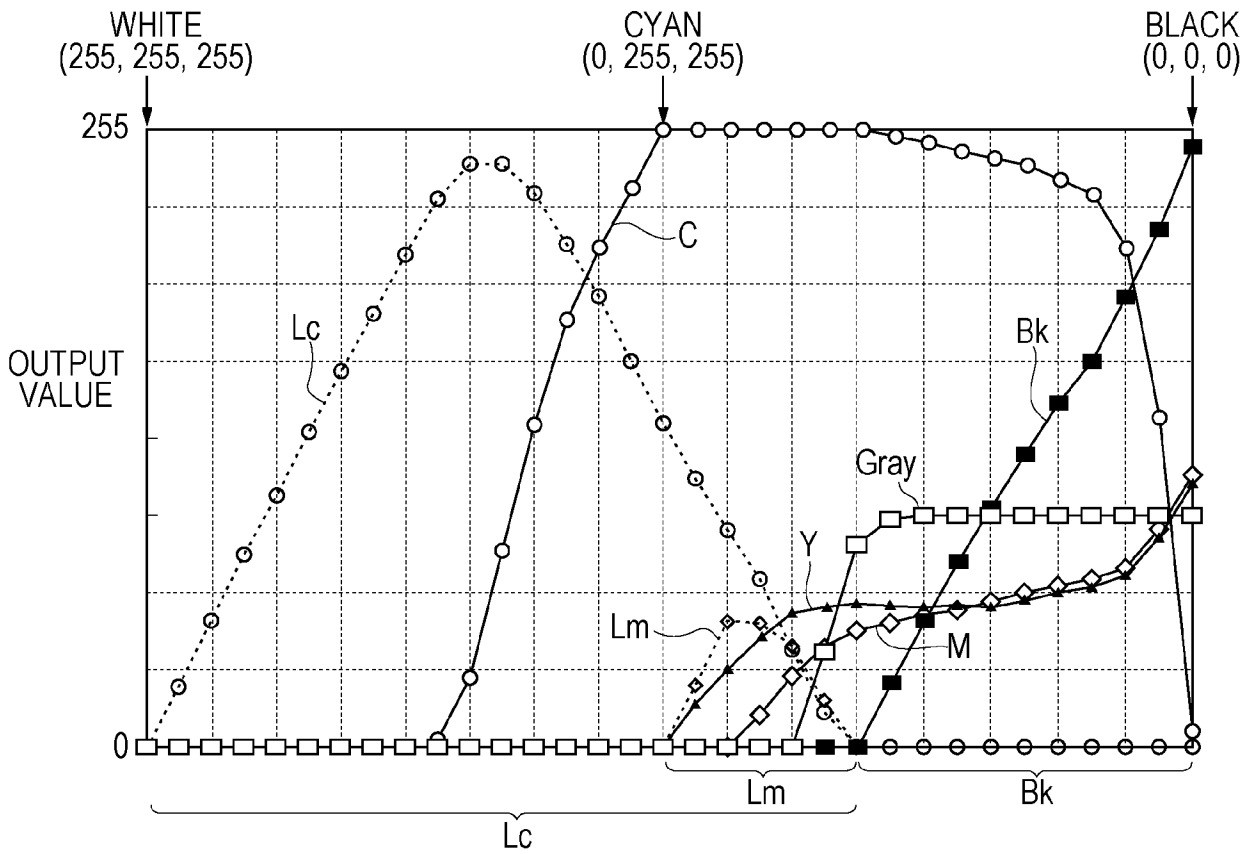
FIG. 8 is a graph illustrating a result of color conversion of RGB data in a cyan line.

FIG. 8 is a graph illustrating a result of ink color conversion in a white→cyan→black line in step S3. The horizontal axis represents the input signal value, and the vertical axis represents the output signal value (0 to 255). In the present embodiment, the recording heads for different colors eject the same amount of ink, and the larger the output value along the vertical axis, the larger the amount of ink ejected onto the recording sheets.

The R'G'B' signal values for white are converted to signal values for the ink colors M, Y, Bk, Lc, Lm, and Gy as follows.

Input values: R'=255, G'=255, B'=255

Output values: C=0, M=0, Y=0, Bk=0, Lc=0, Lm=0, Gy=0

When the color gradually changes from white to cyan, the output value first increases for the ink color Lc, and gradually shifts to the ink color C.

For cyan, the R'G'B' signal values are converted to signal values for the ink colors C, M, Y, Bk, Lc, Lm, and Gy.

Input values: R'=0, G'=255, B'=255

Output values: C=255, M=0, Y=0, Bk=0, Lc=135, Lm=0, Gy=0

When the color changes form cyan to black, the complementary colors Lm and Y increase, and then Lm shifts to M. Meanwhile, Gray increases and finally reaches black.

In the present embodiment, light-colored inks (Lc, Lm) of relatively low density are used to improve graininess. These two inks are usually used for bright colors, and are rarely used simultaneously with Bk ink, which is used for reproducing dark colors. In FIG. 8, after the output values for Lc and Lm have become zero, the output value for Bk becomes larger than zero and then increases. That is, as illustrated in the lower part of FIG. 9, for the white→cyan→black sequence, the range in which Bk ink is used does not overlap the range in which Lc ink is used and the range in which Lm ink is used. Therefore, the combination of Bk ink and Lc ink, and the combination of Bk ink and Lm ink do not exist for any input signal values.

Recording heads for such inks that are not simultaneously used have the overlapping portions that are disposed at the same position in the nozzle array direction. Thus, the length of the recording heads in the nozzle array direction is reduced. That is, even if the positions of the overlapping portions are the same in the nozzle array direction, regions that are recorded by the overlapping portions for such inks, whose combination is not used, do not overlap. Therefore, the positions of the overlapping portions may be the same in the nozzle array direction. The specific structure of the recording head according to the present embodiment will be described below in detail.

Figure 9:
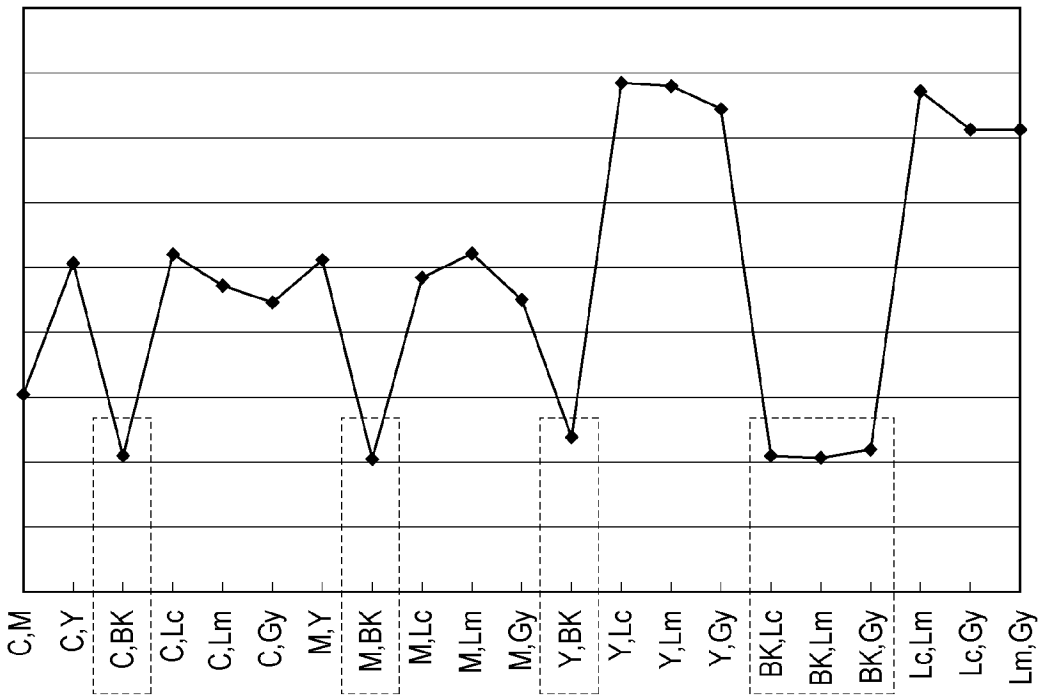
FIG. 9 is a graph illustrating the relationship between combinations of different inks and the frequency with which the inks are simultaneously used.

For lines other than the white→cyan→black line, the frequency with which combinations of different color inks that are simultaneously used are examined as follows. The printer according to the present embodiment includes the recording heads for seven colors. Thus, the number of combinations of two different colors is twenty-one. FIG. 9 is a graph illustrating the relationship between the twenty-one combinations of different inks that are simultaneously used and the frequency with which the combinations are used.

The frequency corresponds to the proportion of the number of colors for which two color inks are used to the number colors recordable by the printer (256×256×256). The proportion is obtained by counting, for all input signal values (RGB data) in step S1, the number of the input signal values for which the product of output signal values in step S5 are not zero. Because the output signal values in step S5 have been quantized, the product is not zero if and only if the signal values for the two colors are present, i.e., if the two colors are simultaneously used. Thus, by counting the number of the input signal values (RGB data) for which the above product is not zero, the frequency with which two different color inks are simultaneously used is obtained.

Referring back to FIG. 9, the horizontal axis represents twenty-one combinations of two different colors. The vertical axis represents the number of input signal values counted as described above. Therefore, the larger the number along the vertical axis, the combination of the inks are more frequently used.

Figure 10:
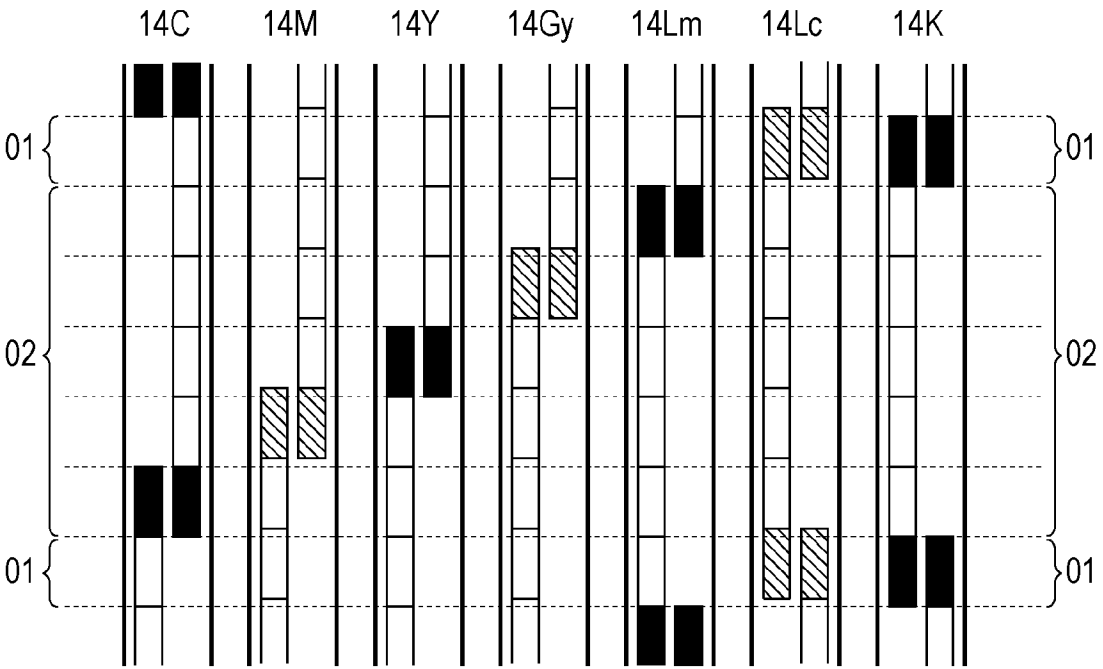
FIG. 10 illustrates the positional relationship between overlapping portions of recording heads according to a modification of the first embodiment.

As can be seen from FIG. 10, the following combinations of inks are used with low frequencies.

(1) Bk ink and M ink
(2) Bk ink and Lm ink
(3) Bk ink and C ink
(4) Bk ink and Lc ink
(5) Bk ink and Gy ink
(6) Bk ink and Y ink As described above, for the recording heads for ink colors that are simultaneously used with a low frequency, the positions of the overlapping portions may be the same in the nozzle array direction.

In the present embodiment, the positions of the overlapping portions of the recording head for BK ink and the recording head for Lc ink are the same in the nozzle array direction. Thus, as illustrated in FIG. 6, the position of the overlapping portion of the recording head 14K and the position of the overlapping portion of the recording head 14Lc are the same in the nozzle array direction, whereby the length of the recording head in the nozzle array direction may be reduced. Moreover, because Bk ink and Lc ink are simultaneously used with a low frequency, the probability that the Bk ink and Lc ink are simultaneously used and non-uniform density occurs is low. As described above, with the present embodiment, overlapping of the regions that are recorded by the overlapping portions is suppressed, occurrence of non-uniform density is suppressed, and reduction in the length of the recording head in the nozzle array direction is realized.

In the description of the present embodiment using FIG. 8, Bk and Lc, and Bk and Lm are not simultaneously used. However, these colors may be used simultaneously. Even if these colors are simultaneously used, when the inks are used with a low duty cycle, non-uniform density does not become conspicuous. Therefore, the positions of the overlapping portions of the recording heads for colors that are used with a low duty cycle may be the same in the nozzle array direction.

Modification of First Embodiment

In the description above, the overlapping portions of the recording heads 14M, 14Y, 14Gy, 14Lm, and 14Lc do not overlap at all in the conveying direction. However, parts (for example, several nozzles) of the overlapping portions may overlap. This is because, even if the colors are simultaneously used with a high frequency, when the overlapping portions overlap in a small region, non-uniform density occurs in the small region, whereby non-uniform density does not become conspicuous. The positions of the overlapping portions of the recording head 14K and the recording head 14Lc are the same in the nozzle array direction. However, parts of the overlapping portions may be disposed at different positions in the nozzle array direction.

According to the present invention, the width with which the overlapping portions for colors that are simultaneously used with a low frequency overlap each other in the conveying direction (a direction that intersects the nozzle array direction) is larger than the width (including zero width) with which the overlapping portions for colors that are simultaneously used with a high frequency overlap in the conveying direction. Thus, with the present invention, occurrence of non-uniform density is suppressed, and reduction in the length of the recording head in the nozzle array direction is realized. According to the present invention, it is assumed that the recording heads for a first color (for example, black) and a second color (for example, light cyan) that are simultaneously used with a low frequency and the recording heads for a third color (for example, cyan) and a fourth color (for example, yellow) that are simultaneously used with a high frequency are provided. The width with which the overlapping portions of the recording heads for the first color and the second color overlap in the conveying direction is larger than the width with which the overlapping portions of the recording heads for the third color and the fourth color overlap in the conveying direction.

FIG. 10 illustrates the positional relationship between the overlapping portions of the recording heads according to the present modification. The positional relationship among the overlapping portions illustrated in FIG. 10 differs from the positional relationship illustrated in FIG. 6 in the positions of the overlapping portions that are shown by shaded areas. In this configuration, a part of the overlapping portion of the recording head 14Lm and a part of the overlapping portion of the recording head 14Gy overlap in the conveying direction, and a part of the overlapping portion of the recording head 14Y and a part of the overlapping portion of the recording head 14M overlap in the conveying direction. However, as described above, even if the colors are simultaneously used with a high frequency, when the overlapping portions overlap in a small region, non-uniform density occurs in the small region, whereby the non-uniform density does not become conspicuous. The overlapping portion of the recording head 14K and the overlapping portion of the recording head 14Lc does not completely overlap in the conveying direction. In this way, parts of the recording heads that are not simultaneously used may be separated from each other in the nozzle array direction. In this case, the overlapping portions of some recording heads, such as the recording heads for gray Gy and yellow Y, are disposed so as to be separated from each other with a distance therebetween in the nozzle array direction. When the overlapping portions are disposed so as not to overlap as illustrated in FIG. 6, if the sheet is obliquely conveyed, regions that are recorded by the overlapping portions may overlap. In contrast, with the present modification illustrated in FIG. 10, even if the sheet is obliquely conveyed, the possibility that the regions recorded by the overlapping portions overlap is reduced for colors whose overlapping portions are separated with a distance therebetween. Therefore, by using such a configuration for the combination of colors for which non-uniform density due to overlapping of the overlapping portions may become conspicuous, occurrence of non-uniform density is effectively suppressed.

Second Embodiment

Next, a second embodiment of the present invention will be described. The elements already described in the first embodiment will be denoted by the same numerals and the description of such elements will be omitted.

In the first embodiment and the modification of the first embodiment, the width with which the overlapping portions for colors that are simultaneously used with a low frequency overlap in the conveying direction is larger than the width with which the overlapping portions for colors that are simultaneously used with a high frequency overlap in the conveying direction. In contrast, in the present embodiment, the width with which the overlapping portions for colors, for which a small amount of ink is used when the colors are simultaneously used, overlap in the conveying direction is larger than the width with which the overlapping portions for colors, for which a large amount of ink is used when the colors are simultaneously used, overlap in the conveying direction. This is because, even when the frequency of with which color inks are simultaneously used is low, if the amount of inks simultaneously used is large, non-uniform density becomes conspicuous.

The amount of ink simultaneously used corresponds to the total amount of ink for the number of colors (256×256×256) recordable by the printer. For all input signal values (RGB data) in step S1, the sum of the output signal values in step S5 is calculated. The output signal value in step S5 has been quantized. Therefore, by multiplying the sum by the input signal values (RGB data), the number of dots that are simultaneously recorded, i.e., the amount of ink used when two different color inks are simultaneously used is calculated.

Figure 11:
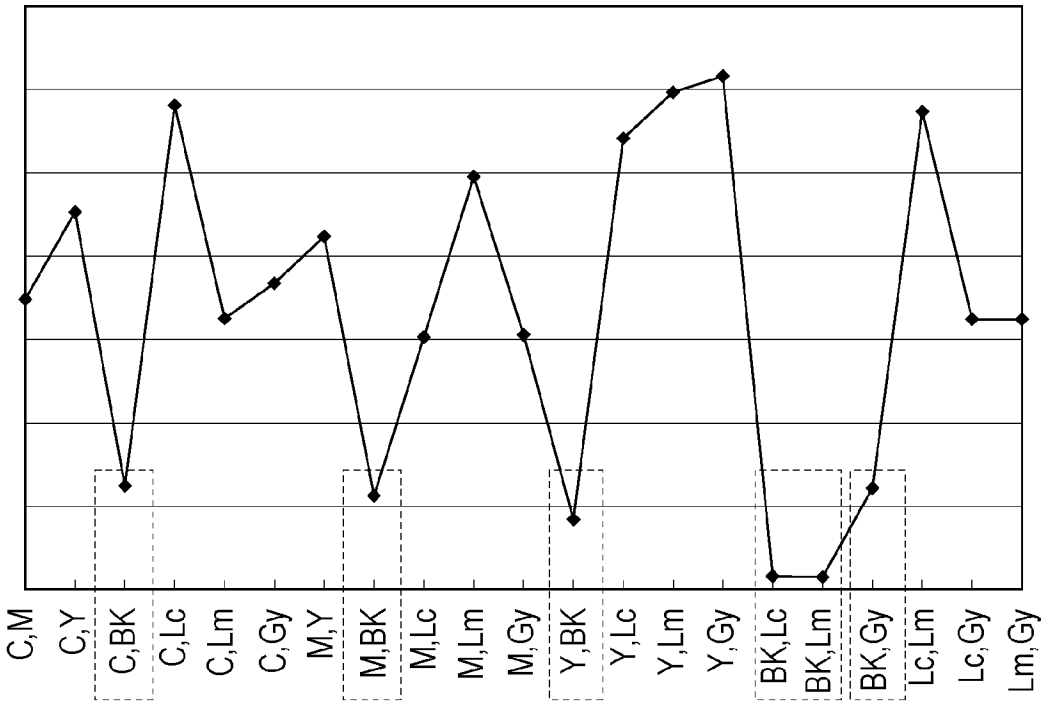
FIG. 11 is a graph illustrating the relationship between combinations of different inks and the amount of the inks simultaneously used.

FIG. 11 is a graph illustrating the relationship between (twenty-one) combinations of different inks and the amount of the inks simultaneously used. As can be seen from FIG. 11, combinations of inks that are simultaneously used with a small amount are as follows.

(1) Bk ink and Lc ink
(2) Bk ink and Lm ink

Combinations of inks that are simultaneously used with a comparatively small amount are as follows.

(3) Bk ink and C ink
(4) Bk ink and M ink
(5) Bk ink and Y ink
(6) Bk ink and Gy ink As described above, when the amount of ink simultaneously used is taken into consideration, disposing the overlapping portion for the Bk ink and the overlapping portions for the light-colored inks (Lc, Lm) at the same position or in a partially overlapping position in the nozzle array direction is effective. Therefore, as illustrated in FIG. 6, when the position of the overlapping portion of the recording head for Bk and the position of the overlapping portion of the recording head for Lc are the same in the nozzle array direction, even if the Bk ink and the Lc ink are simultaneously used, the inks are used with a small amount, so that non-uniform density is inconspicuous. Thus, with the present embodiment, occurrence of non-uniform density is suppressed, and the length of the recording head in the nozzle array direction is reduced.

Third Embodiment

Next, a third embodiment of the present invention will be described. The elements already described in the first and second embodiments will be denoted by the same numerals and the description of such elements will be omitted. In the present embodiment, the positions of the overlapping portions of the recording heads for three colors are the same in the nozzle array direction.

Figure 12:
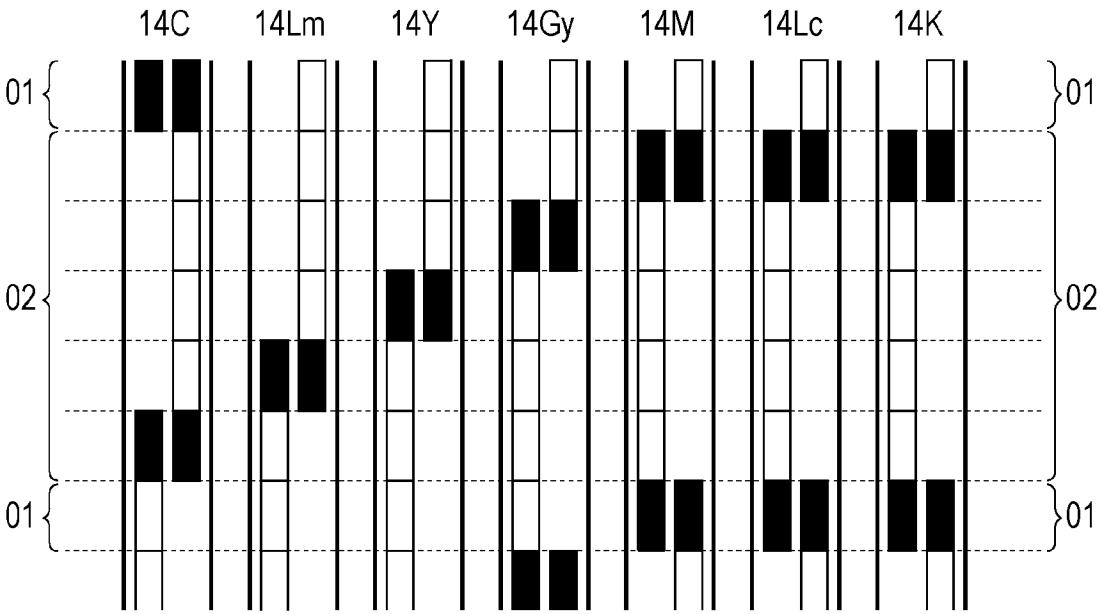
FIG. 12 illustrates the positional relationship between overlapping portions of recording heads according to a third embodiment.

FIG. 12 illustrates the positional relationship between overlapping portions of the recording heads according to the present embodiment. As illustrated in FIG. 12, the position of the overlapping portion of the recording head 14K for Bk, the position of the overlapping portion of the recording head 14Lc for Lc, and the position of the overlapping portion of the recording head 14M for M are the same in the nozzle array direction. This because, in the graph of FIG. 11 illustrating the amount of inks used when the colors are simultaneously used, the amount of inks that are simultaneously used is small for the combinations of Bk ink and light-colored inks (Lc, Lm), and comparatively small for the combination of M ink and Lc ink.

Therefore, in the present embodiment, for the recording head 14K for Bk, the recording head 14Lc for Lc, and the recording head 14M for M, the positions of the overlapping portions are the same in the nozzle array direction. In this way, by making the positions of the overlapping portions of the recording heads for two or more colors be the same in the nozzle array direction, further reduction in the length of the recording head in the nozzle array direction is realized.

Other

Some inkjet recording apparatuses use a high chroma ink having a so-called spot color or a special color, which is different from the process colors. Examples of such inks include an orange (Or) ink, a green (G) ink, and a blue (B) ink. These inks are used in a part of the color reproduction range, and are not simultaneously used with other inks. For a printer that uses such special colors, by overlapping the overlapping portion of the recording head for at least one of the special colors with the overlapping portion for the recording head for a color other than the special colors, the size of the recording head in the nozzle array direction may be reduced. In FIGS. 9 and 11, the combinations of colors that are used with a low frequency or a small amount are based on the color processing illustrated in FIG. 7. For a different color processing, the combinations may be different from those in FIGS. 9 and 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-139955 filed Jun. 18, 2010, which is hereby incorporated by reference herein in its entirety.

What is claimed is:

1. An inkjet recording apparatus comprising:

at least four recording heads including a plurality of nozzle arrays in which a plurality of nozzles are arrayed in an arraying direction, each corresponding to a first color ink, a second color ink, a third color ink, and a fourth color ink and being arranged in an intersecting direction that is substantially perpendicular to the arraying direction, wherein the nozzle arrays in each of the four recording heads are arranged in the arraying direction such that predetermined number of nozzles arrayed in an end portion of one nozzle array and predetermined number of nozzles arrayed in an end portion of a nozzle array which is adjoined to the one nozzle array and shifted to the one nozzle array in the arraying direction form an overlapping portion which is able to eject ink to same position on a recording medium in the arraying direction, and a controlling unit configured to control ejection of ink from the recording head to the recording medium for forming an image on the recording medium based on data of image while the relative movement of the four recording heads and the recording medium in a moving direction that intersects to the arraying direction, wherein a number of colors represented by using the first color ink and the second color ink in representable colors that are representable based on the data by the inkjet recording apparatus is fewer than a number of colors represented by using the third color ink and the fourth color ink in the representable colors, and wherein a width with which the overlapping portion of the recording head for the first color ink and the overlapping portion of the recording head for the second color ink overlap in the arraying direction is larger than a width with which the overlapping portion of the recording head for the third color ink and the overlapping portion of the recording head for the fourth color ink overlap in the arraying direction.

2. The inkjet recording apparatus according to claim 1, wherein a position of the overlapping portion of the recording head for the first color ink and a position of the overlapping portion of the recording head for the second color ink are coincident coincide in the arraying direction.

3. The inkjet recording apparatus according to claim 1, wherein a position of the overlapping portion of the recording head for the third color ink and a position of the overlapping portion of the recording head for the fourth color ink do not overlap in the arraying direction.

4. The inkjet recording apparatus according to claim 1, wherein a position of the overlapping portion of the recording head for the third color and a position of the overlapping portion of the recording head for the fourth color are separated from each other at predetermined distance in the arraying direction.

5. The inkjet recording apparatus according to claim 1, wherein the second color ink is any one of orange, green, or blue ink.

6. The inkjet recording apparatus according to claim 1, further comprising, a color conversion unit configured to convert signal values for RGB of the data of the image into signal values for ink colors, such that in the case that the signal values for RGB is a predetermined value the first color ink is not used for forming image representing colors and the second ink is used for representing colors, and in the case that the signal value for RGB is higher than the predetermined value the first ink is used for representing colors and the second color ink is not used for representing colors.

7. The inkjet recording apparatus according to claim 6, wherein the at least four recording heads includes a recording head corresponding to a primary color ink and a recording head corresponding to a light-colored ink which is same hue as the primary color ink and lighter than the primary color ink, and wherein the first color ink is a black ink and the second color ink is the light-colored ink.

8. The inkjet recording apparatus according to claim 7, wherein the second color ink is a light cyan ink.

9. The inkjet recording apparatus according to claim 7, wherein the second color ink is a light magenta ink.

10. An inkjet recording method for forming an image on a recording medium by using at least four recording heads including a plurality of nozzle arrays in which a plurality of nozzles are arrayed in an arraying direction, each corresponding to a first color ink, a second color ink, a third color ink, and a fourth color ink and being arranged in an intersecting direction that is substantially perpendicular to the arraying direction, wherein the nozzle arrays in each of the four recording heads are arranged in the arraying direction such that predetermined number of nozzles arrayed in an end portion of one nozzle array and predetermined number of nozzles arrayed in an end portion of a nozzle array which is adjoined to the one nozzle array and shifted to the one nozzle array in the arraying direction form an overlapping portion which is able to eject ink to same position on a recording medium in the arraying direction, the inkjet recording method comprising:

controlling ejection of ink from the recording head to the recording medium for forming an image on the recording medium based on data of image while the relative movement of the four recording heads and the recording medium in a moving direction that intersects to the arraying direction, wherein a number of colors represented by using the first color ink and the second color ink in representable colors that are representable based on the data by the inkjet recording method is fewer than a number of colors represented by using the third color ink and the fourth color ink in the representable colors, and wherein a width with which the overlapping portion of the recording head for the first color ink and the overlapping portion of the recording head for the second color ink overlap in the arraying direction is larger than a width with which the overlapping portion of the recording head for the third color ink and the overlapping portion of the recording head for the fourth color ink overlap in the arraying direction.

11. The inkjet recording method according to claim 10, wherein a position of the overlapping portion of the recording head for the first color ink and a position of the overlapping portion of the recording head for the second color ink are coincident in the arraying direction.

12. The inkjet recording method according to claim 10, wherein a position of the overlapping portion of the recording head for the third color ink and a position of the overlapping portion of the recording head for the fourth color ink do not overlap in the arraying direction.

13. The inkjet recording method according to claim 10, wherein a position of the overlapping portion of the recording head for the third color and a position of the overlapping portion of the recording head for the fourth color are separated from each other at predetermined distance in the arraying direction.

14. The inkjet recording method according to claim 10, further comprising, a color conversion step configured to convert signal values for RGB of the data of the image into signal values for ink colors, such that in the case that the signal values for RGB is a predetermined value the first color ink is not used for forming image representing colors and the second ink is used for representing colors, in the case that the signal values for RGB is higher than the predetermined value the first ink is used for representing colors and the second color ink is not used for representing colors.

15. The inkjet recording method according to claim 14, wherein the at least four recording heads includes a recording head corresponding to a primary color ink and a recording head corresponding to a light-colored ink which is same hue as the primary color ink and lighter than the primary color ink, and wherein the first color ink is a black ink and the second color ink is the light-colored ink.

16. The inkjet recording method according to claim 15, wherein the second color ink is a light cyan ink.

17. An inkjet recording apparatus comprising:

at least four recording heads including a plurality of nozzle arrays in which a plurality of nozzles are arrayed in an arraying direction, each corresponding to a black ink, a first primary color ink, a light-colored ink which is same hue as the first primary color ink and has lighter density than the first primary ink, and a second primary color ink, and being arranged in an intersecting direction that is substantially perpendicular to the arraying direction, wherein the nozzle arrays in each of the four recording heads are arranged in the arraying direction such that predetermined number of nozzles arrayed in an end portion of one nozzle array and predetermined number of nozzles arrayed in an end portion of a nozzle array which is adjoined to the one nozzle array and shifted to the one nozzle array in the arraying direction form an overlapping portion which is able to eject ink to same position on a recording medium in the arraying direction, and a controlling unit configured to control ejection of ink from the recording head to the recording medium for forming an image on the recording medium based on data of image while the relative movement of the four recording heads and the recording medium in a moving direction that intersects to the arraying direction, wherein a width with which the overlapping portion of the recording head for the black ink and the overlapping portion of the recording head for the light-colored ink overlap in the arraying direction is larger than a width with which the overlapping portion of the recording head for the first primary color ink and the overlapping portion of the recording head for the second primary color ink overlap in the arraying direction.

18. The inkjet recording apparatus according to claim 17, wherein a position of the overlapping portion of the recording head for the black ink and a position of the overlapping portion of the recording head for the light-colored ink are coincident in the arraying direction.

19. The inkjet recording apparatus according to claim 17, wherein a position of the overlapping portion of the recording head for the first primary color ink and a position of the overlapping portion of the recording head for the second primary color ink do not overlap in the arraying direction.

20. The inkjet recording apparatus according to claim 17, wherein a position of the overlapping portion of the recording head for the first primary color and a position of the overlapping portion of the recording head for the second primary color are separated from each other at predetermined distance in the arraying direction.

* * * * *